US006258016B1

(12) United States Patent
Kuo

(10) Patent No.: US 6,258,016 B1
(45) Date of Patent: Jul. 10, 2001

(54) FOLDING COLLAPSIBLE EXERCISING APPARATUS

(76) Inventor: Johnson Kuo, 5F., No. 6, Lane 12, Sec. 6, Hsin I Rd., Taipei (TW)

( * ) Notice: Subject to any disclaimer, the term of this patent is extended or adjusted under 35 U.S.C. 154(b) by 0 days.

(21) Appl. No.: 09/436,232

(22) Filed: Nov. 9, 1999

(51) Int. Cl.[7] ..... A63B 26/00

(52) U.S. Cl. ..... 482/142; 482/140; 482/96; 482/121; 482/122; 482/129

(58) Field of Search ..... 482/142, 122–126, 482/130, 131, 133, 129, 96, 121, 140

(56) References Cited

U.S. PATENT DOCUMENTS 5,520,599 * 5/1996 Chen ..... 482/96
5,527,250 * 6/1996 Chen ..... 482/96
5,971,894 * 10/1999 Chen ..... 482/57

* cited by examiner

*Primary Examiner*—Jerome W. Donnelly
*Assistant Examiner*—Lori Baker Amerson
(74) *Attorney, Agent, or Firm*—Varndell & Varndell, PLLC

(57) ABSTRACT

A folding collapsible exercising apparatus including a wheeled front frame, a tubular bearing bracket, a back frame unit, a wheeled seat, a coupling, a damping device, and two handlebars. The wheeled front frame unit has a backwardly extending longitudinal shaft, and the tubular bearing bracket is slidably sleeved onto the longitudinal shaft of the wheeled front frame unit. The back frame unit is pivoted to the tubular bearing bracket and turned by the user between vertical and horizontal positions. The wheeled seat pivots to the back frame unit and is slidably supported on the tubular bearing bracket. The coupling moves along the longitudinal shaft of the wheeled front frame unit and is locked by a lock screw. The dampening device coupled between the coupling and the bearing bracket, and the two handlebars are pivoted to the back frame unit at two opposite sides and locked by a respective lock screw.

3 Claims, 7 Drawing Sheets

FOLDING COLLAPSIBLE EXERCISING APPARATUS

BACKGROUND AND SUMMARY OF THE INVENTION

The present invention relates to a physical exercising apparatus, and more particularly to a folding collapsible exercising apparatus, which is functional for exercising the legs, the waist, the back, and the feet.

U.S. Pat. No. 4,583,731 shows an exercising apparatus. This exercising apparatus (see FIG. 1) enables the user to exercise the body in a lying or any of a variety of exercising postures. However, the parts of the exercising apparatus are not movable with the motion of the user.

It is one object of the present invention to provide an exercising apparatus, which is folding collapsible. It is another object of the present invention to provide a folding collapsible exercising apparatus, which can be conveniently adjusted subject to the body height of the user. It is still another object of the present invention to provide a folding collapsible exercising apparatus, which is functional for exercising the legs, the waist, the back, and the feet. According to one aspect of the present invention, the folding collapsible exercising apparatus comprises a wheeled front frame unit having a backwardly extended longitudinal shaft, a tubular bearing bracket slidably sleeved onto the longitudinal shaft of the wheeled front frame unit, a back frame unit pivoted to the tubular bearing bracket and turned by the user between a vertical position and a horizontal position, a wheeled seat pivoted to the back frame unit and slidably supported on the tubular bearing bracket, a coupling moved along the longitudinal shaft of the wheeled front frame unit and locked by a lock screw, a damping device coupled between the coupling and the bearing bracket, and two handlebars pivoted to the back frame unit at two opposite sides by locked by a respective lock screw. According to another aspect of the present invention, the back frame unit comprises two smoothly arched frame tubes for supporting the back frame unit on the floor, enabling the back frame unit to be turned by the user between the horizontal position and the vertical position, and two foot members respectively provided at the smoothly arched frame tubes for stopping at the floor to limit the turning angle of the back frame unit.

DETAILED DESCRIPTION OF THE PREFERRED EMBODIMENT

Figure 1:
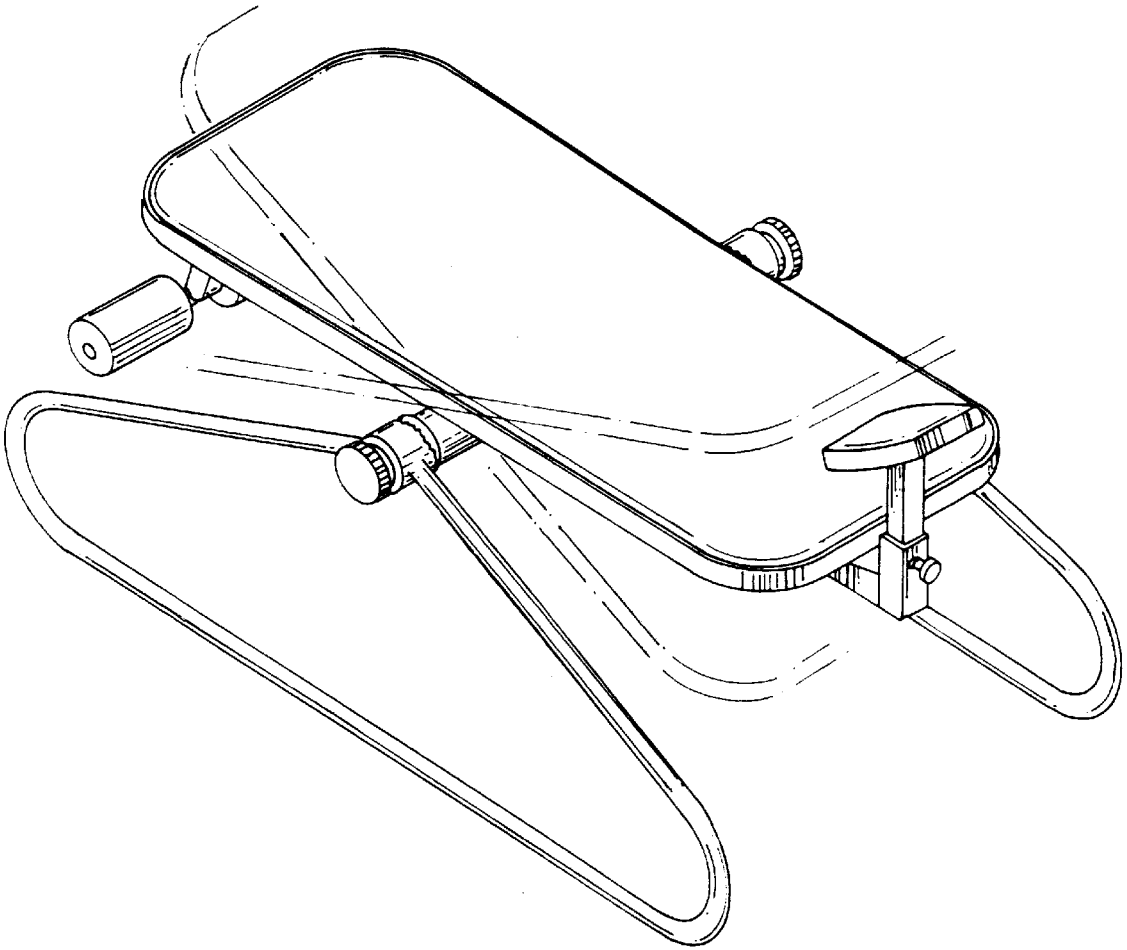
Fig. 1 PRIOR ART
FIG. 1 is an elevational view of an exercising apparatus according to the prior art.

Referring to Figures from 2 through 7, a multipurpose exercising apparatus in accordance with the present invention is practical for exercising the back, the waist, the legs, and the feet. The multipurpose exercising apparatus is comprised of a front frame unit 1, a bearing bracket 2, a back frame unit 3, two handlebars 4, and a seat 5, a damping device 6, and a coupling 8.

The front frame unit 1 comprises a transverse front bar 11, two wheels 111 at two distal ends of the transverse front bar 11, a longitudinal shaft 12 perpendicularly extended from a middle part of the transverse front bar 11, the longitudinal shaft 12 having a vertical front section 121 fixedly connected to the transverse front bar 11, a horizontal rear section 122 inserted through the coupling 8 into the bearing bracket 2, two foot bars 1211 bilaterally connected to the vertical front section 121 of the longitudinal shaft 12, and a series of positioning holes 1221 longitudinally spaced on the horizontal rear section 122 of the longitudinal shaft 12 and selectively fastened to the coupling 8 by a lock screw 20.

Figure 2:
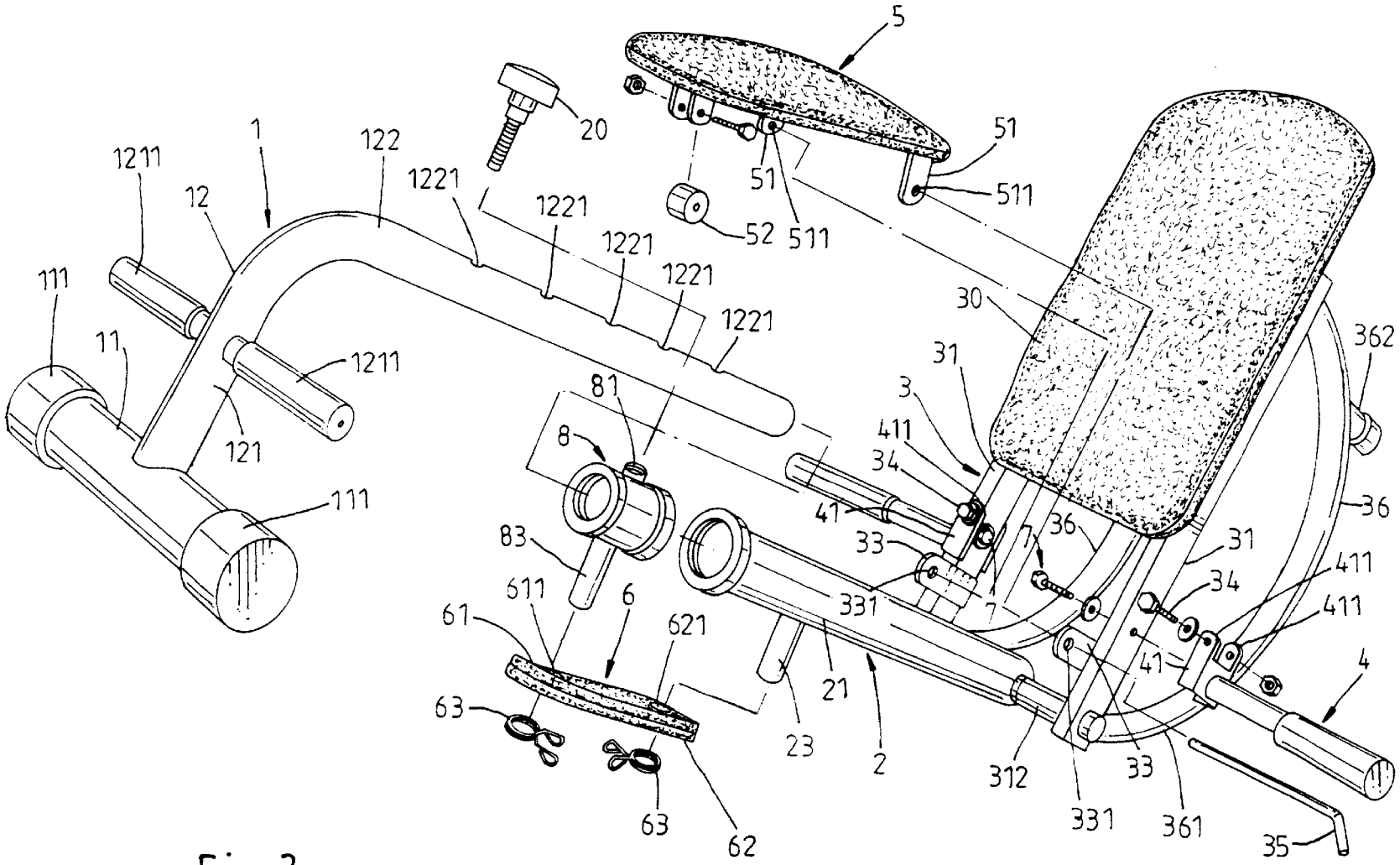
FIG. 2 is an exploded view of a folding collapsible exercising apparatus according to the preferred embodiment of the present invention.
Figure 3:
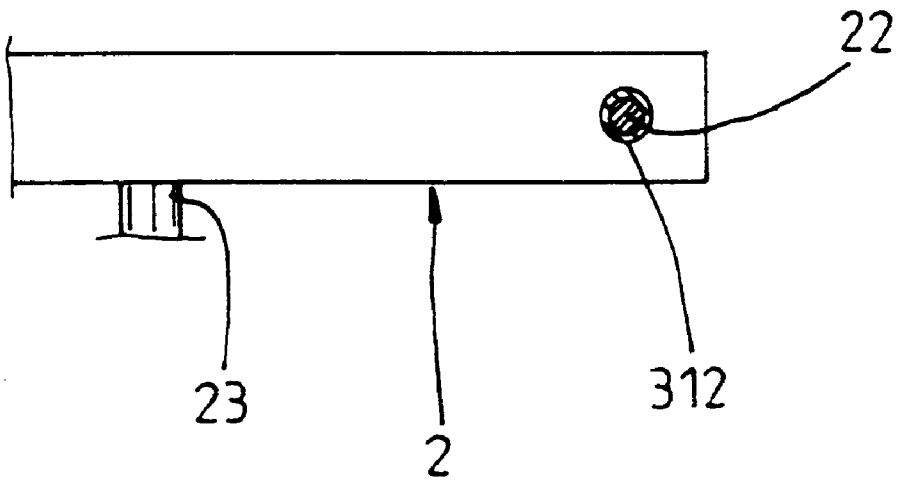
FIG. 3 is a sectional view of a part of the present invention, showing the connection between the coupling tube at the back frame unit and the corresponding stub axle at the bearing bracket.

The bearing bracket 2 comprises a longitudinal main tube 21, which receives the rear end of the horizontal rear section 122 of the longitudinal shaft 12, two stub axles 22 formed integral with one end, namely, the rear end of the longitudinal main tube 21 at two opposite sides and respectively coupled to two coupling tubes 312 of the back frame unit 3 (see FIGS. 2 and 3), and a vertical bottom rod 23 perpendicularly extended from the longitudinal main tube 21 and coupled to the rear end 62 of the damping device 6.

The coupling 8 is a tubular member sleeved onto the horizontal rear section 122 of the longitudinal shaft 12, having a top screw hole 81 selectively fastened to one of the positioning holes 1221 on the horizontal rear section 122 of the longitudinal shaft 12 by the lock screw 20, and a vertical bottom rod 83 coupled to the front end 61 of the damping device 6.

The back frame unit 3 comprises two parallel back support bars 31, a back mattress 30 supported on the back support bars 31, two coupling tubes 312 respectively perpendicularly extended from the back support bars 31 toward each other near the bottom end respective main tube 21 of the bearing bracket 2 (see FIG. 3), two lugs 33 respectively provided at the back support bars 31 above the coupling tubes 312, the lugs 33 each having a mounting hole 331, a pivot pin 35 inserted through the mounting hole 331 on each lug 33 to secure the seat 5 to be back frame unit 3, and two smoothly arched frame tubes 36 respectively connected to the back support bars 31 and arranged in parallel. When set up, one end 361 of each smoothly arched frame tube 36 is disposed in contact with the floor to support the rear part of the multipurpsoe exercising apparatus stably on the floor.

The two handlebars 4 are respectively pivoted to the back support bars 31, and locked in the operative position by a respectively lock screw 7, each having a ⊓-shaped coupling frame 41 and two parallel lugs 411 raised from the ⊓-shaped coupling frame 41 at two opposite sides. The parallel lugs 411 of the ⊓-shaped coupling frame 41 of one handlebar 4 are pivotablly conected to two opposite side walls of the corresponding back support bar 31 by a pivot bolt 34.

The seat 5 comprises two bottom lugs 51 bilaterally disposed at the rear side thereof and respectively pivoted to the pivot pin 35, the bottom lugs 51 each having a pivot hole 511, which receives the pivot pin 35, and a bottom roller 52 disposed at the front side thereof for supporting the seat 5 on the main tube 21 of the bearing bracket 2.

The damping device 6 comprises a first coupling hole 611 disposed on the front end 61 thereof and coupled to the vertical bottom rod 83 of the coupling 8, a second coupling hole 621 disposed on the rear end 62 thereof and coupled to the vertical bottom rod 23 of the bearing bracket 2, and two springy retainers 63 respectively fastened to the vertical bottom rod 83 of the coupling 8 and the vertical bottom rod 23 of the bearing bracket 2 to secure the damping device 6, the coupling 8 and the bearing bracket 2 together.

Figure 4:
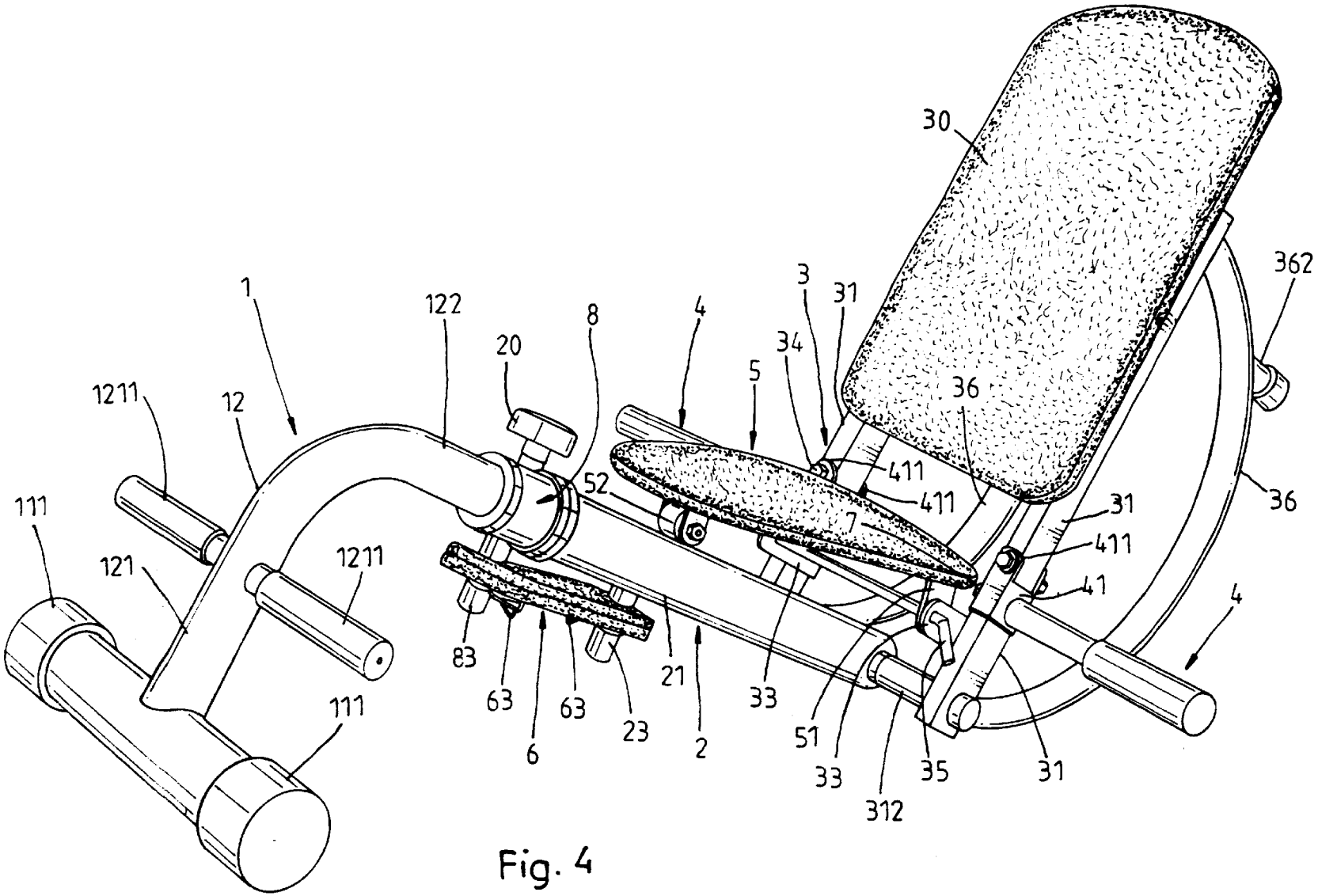
FIG. 4 is an elevational view of the multipurpose exercising apparatus according to the present invention.
Figure 5:
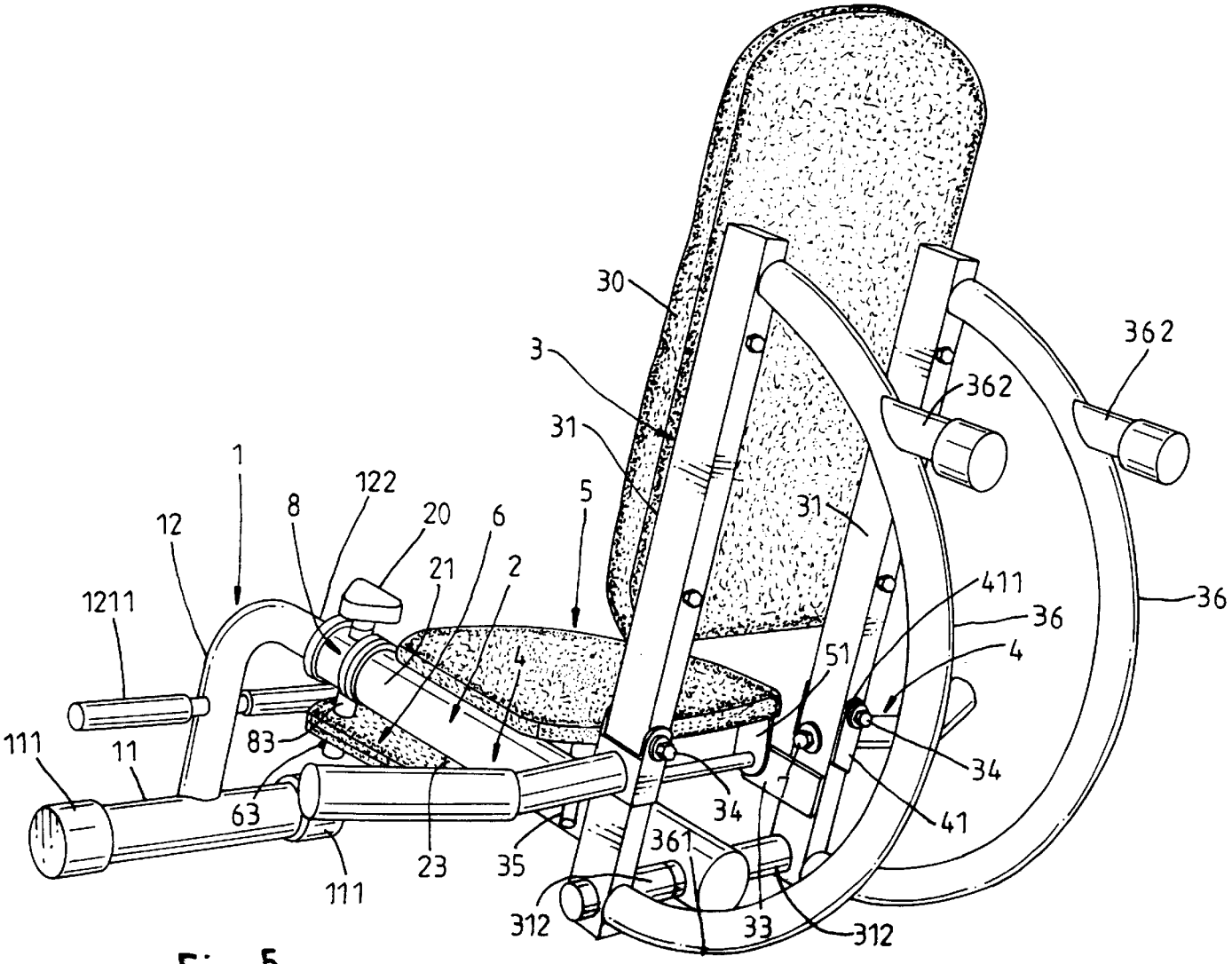
FIG. 5 is another elevational view of the folding collapible exercising apparatus according to the present invention when viewed from another angle.
Figure 6:
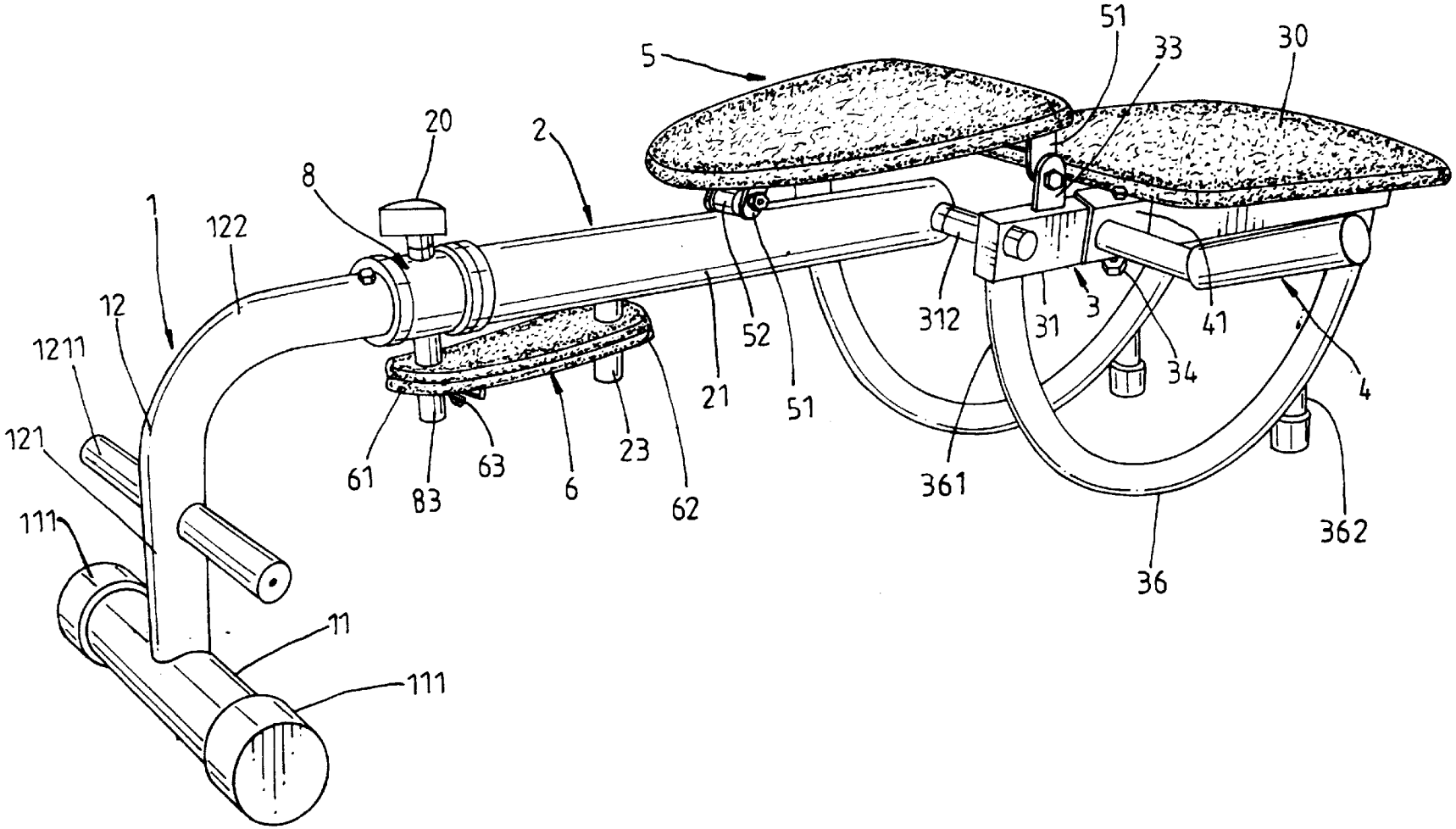
FIG. 6 is an applied view of the present invention, showing the back frame unit turned at the horizontal position.

When in use, the user sits on the seat 5 with the back supported on the back mattress 30, the feet stepped on the foot bars 1211, and the hands, grasped at the handlebars 4, then the user pushes the legs forwards and bends the trunk backwards and then releases the legs and bends the trunk forwards, and then the action is repeated again and again. When the user pushes the legs forwards and bends the trunk backwards, the back frame unit 3 is turned backwards from the vertical position shown in FIG. 4 to the horizontal position shown in FIG. 6, the seat 5 is moved backwards with the back frame unit 3 along the main tube 21 of the bearing bracket 2, the front frame unit 1 is pushed forwards relative to the bearing bracket 2, and the main tube 21 is moved with the bearing bracket 2 backwards to stretch the damping device 6, causing the damping device 6 to impart to resisting force.

Figure 7:
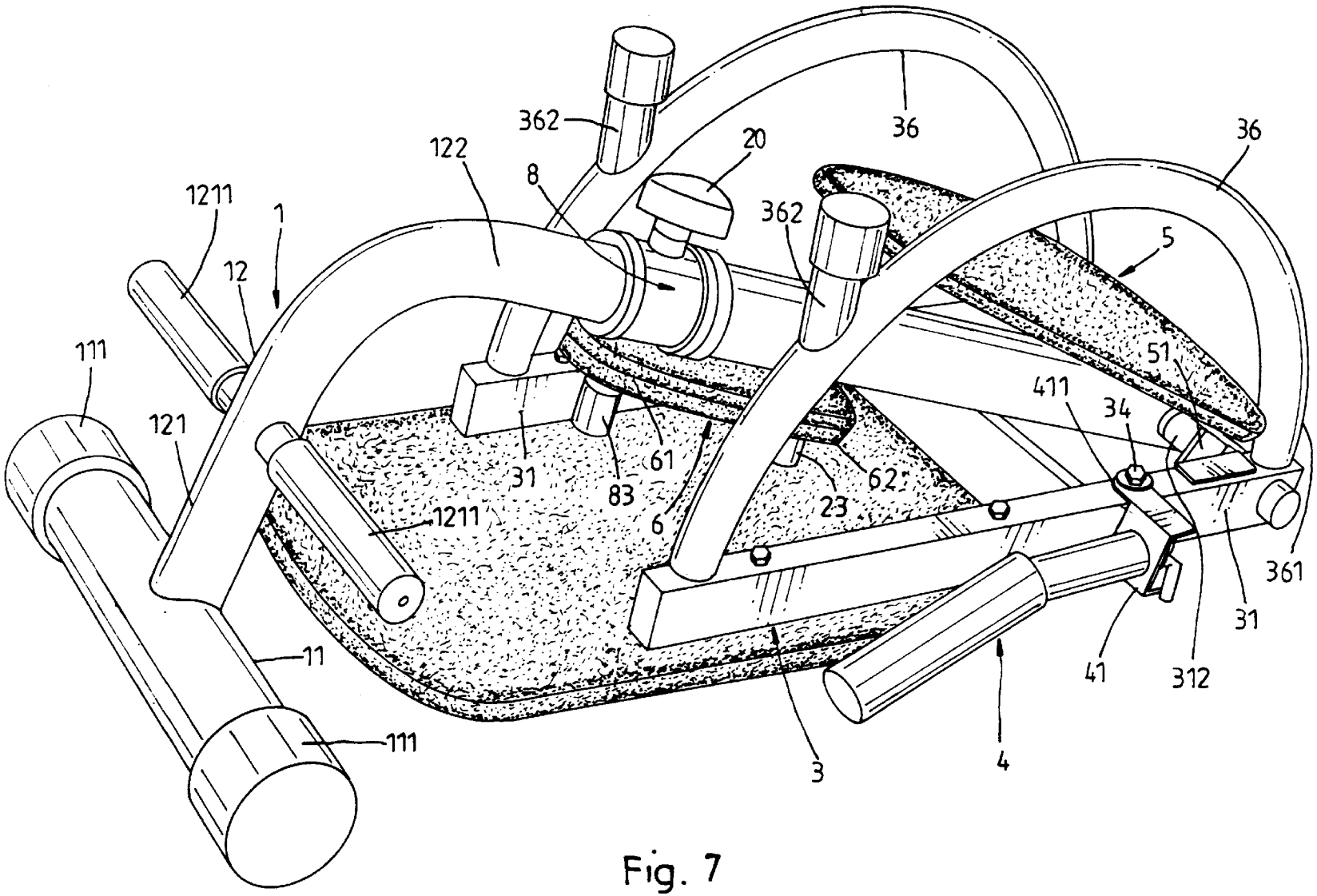
FIG. 7 shows the folding collapsible exercising apparatus collapsed according to the present invention.

When not in use, the pivot pin 35 is removed from the lugs 33 at the back frame unit 3 and the rear lugs 51 at the seat 5, enabling the seat 5 to be taken away, and the back frame unit 3 to be turned backwards and closely attached to the front frame unit 1, and then the lock screws 7 are respectively removed from back support board 31 and the handlebars 4, enabling the handlebars 4 to be turned about the respective pivot bolts 34 upwardly and closely attached to the back support bars 31 (see FIG. 7). When collapsed, the detached seat 5 is placed on the bearing bracket 2 between the smoothed arched frame tubes 36 of the back frame unit 3.

The back frame unit 3 further comprises two foot members 362 respectively provided at the smoothly arched frame tubes 36. When the back frame unit 3 is turned backwards to the horizontal position shown in FIG. 6, the foot members 362 are stopped at the floor to limit the turning angle of the back frame unit 3. Further, according to the present preferred embodiment of the present invention, the damping device 6 is a rubber element. Alternatively, a spring member may be used to take the place of the dampling device 6.

As indicated above, the present invention provide a collapsible exercising apparatus, which achieves the advantages outlined hereinafter.

1. The exercising apparatus is effective to exercise the back, the waist, the legs, and the feet.

2. After removal of the pivot pin 35, the back frame unit 3 can be turned backwards to the collapsed position and closely attached to the front frame unit 1 to minimize the dimension of the exercising apparatus.

3. Because the front frame unit 1 has a series of longitudinally spaced positioning holes 1221 selectively fastened to the top screw hole 81 on the coupling 8 by the lock screw 20, the user can adjsut the connection between the longitudinal shaft 12 of the front frame unit 1 and the coupling 8 subject to one's body height.

4. Because the back frame unit 3 comprises two foot members 362 at the smoothly arched frame tubes 36, the turning angle of the back frame unit 3 is limited to the range between the horizontal position and the vertical position.

I claim:

1. A folding collapsible exercising apparatus comprising:

a front frame unit, said front frame unit comprising a transverse front bar, two wheels at two distal ends of said transverse front bar, a longitudinal shaft perpendicularly extended from a middle part of said transverse front bar, said longitudinal shaft having a vertical front section fixedly connected to said transverse front bar, a horizontal rear section, a series of positioning holes longitudinally spaced on said horizontal rear section of said longitudinal shaft, and two foot bars bilaterally connected to said vertical front section of said longitudinal shaft;

a bearing bracket, said bearing bracket comprising a longitudinal main tube sleeved onto the horizontal rear section of said longitudinal shaft of said front frame unit, two stub axles formed integral with one end of said longitudinal main tube at two opposite sides remote from said front frame unit, and a vertical bottom rod perpendicularly extended from said longitudinal main tube;

a coupling sleeved onto the horizontal rear section of said longitudinal shaft of said front frame unit, said coupling comprising a top screw hole fastened to one of the positioning holes on the horizontal rear section of said longitudinal shaft of said front frame unit, and a vertical bottom rod;

a first lock screw selectively mounted in one of the positioning holes on the horizontal rear section of said longitudinal shaft of said front frame unit and threaded into the top screw hole on said coupling to secure said coupling to said front frame unit;

a back frame unit pivoted to said bearing bracket and turned between a vertical position and a horizontal position, said back frame unit comprising two parallel back support bars, a back mattress supported on said back support bars, two coupling tubes respectively perpendicularly extended from said back support bars at a bottom side and respectively pivoted to the two stub axles at the longitudinal main tube of said bearing bracket, two lugs respectively provided at said back support bars above said coupling tubes, and two smoothly arched frame tubes respectively connected to said back support bars and arranged in parallel for supporting said back frame unit on the floor;

two handlebars respectively pivoted to the back support bars of said back frame unit, said handlebars each comprising a ⊓-shaped coupling frame respectively pivoted to the back support bars of said back frame unit by a respective pivot bolt;

two second lock screws respectively fastened to the back support bars of said back frame unit and said handlebars to lock said handlebars;

a seat pivoted to said back frame unit and moved with said back frame unit along the main tube of said bearing bracket, said seat comprising two bottom lugs bilaterally disposed at a rear side thereof and respectively pivoted to the lugs at the back support bars of said back frame unit by a pivot pin, and a bottom roller disposed at a front side thereof for supporting said seat on the main tube of said bearing bracket; and a damping device coupled between said coupling and said bearing bracket, said damping device comprising a first coupling hole disposed on a front end thereof and coupled to the vertical bottom rod of said coupling, a second coupling hole disposed on a rear end thereof and coupled to the vertical bottom rod of said bearing bracket, and two springy retainers respectively fastened to the vertical bottom rod of said coupling and the vertical bottom rod of said bearing bracket to secure said damping device, said coupling and said bearing bracket together.

2. The folding collapsible exercising apparatus of claim 1 wherein said back frame unit further comprises two foot members respectively provided at said smoothly arched frame tubes for supporting said back frame unit on the floor when said back frame unit is turned to said horizontal position.

3. The folding collapsible exercising apparatus of claim 1 wherein said springy retainers are made of rubber.

* * * * *